US010359212B2

(12) United States Patent
Darby

(10) Patent No.: US 10,359,212 B2
(45) Date of Patent: Jul. 23, 2019

(54) APPARATUS AND METHOD FOR SECURING AN AIR CONDITIONING UNIT IN A WINDOW

(71) Applicant: Nation Wide Products LLC, Abilene, TX (US)

(72) Inventor: Jason Darby, Abilene, TX (US)

(73) Assignee: Nation Wide Products LLC, Abilene, TX (US)

( * ) Notice: Subject to any disclaimer, the term of this patent is extended or adjusted under 35 U.S.C. 154(b) by 0 days.

(21) Appl. No.: 15/152,434

(22) Filed: May 11, 2016

(65) Prior Publication Data

US 2017/0328596 A1 Nov. 16, 2017

(51) Int. Cl.
*F24F 13/32* (2006.01)
*F24F 1/027* (2019.01)

(52) U.S. Cl.
CPC ..... *F24F 13/32* (2013.01); *F24F 1/027* (2013.01); *F24F 2221/20* (2013.01)

(58) Field of Classification Search
CPC .... F24F 13/32; F24F 2221/20; F24F 2221/44; F24F 1/027; F16B 2/065; E05C 19/188; E06B 7/03
USPC ..... 454/204; 62/262; 248/208, 209, 210, 248/211, 301, 304, 500, 505, 229.15, 248/229.16, 229.25, 229.26, 228.6, 228.7, 248/230.6, 230.7, 227.1, 215, 322, 339
See application file for complete search history.

(56) References Cited

U.S. PATENT DOCUMENTS 1,536,900 A * 5/1925 Lowe ..... 248/229.15
2,608,148 A * 8/1952 Shapiro ..... E06B 7/02 248/208
3,371,900 A 3/1968 Jacobs
4,227,307 A * 10/1980 Tassoni ..... B25H 7/00 33/41.6
5,695,296 A * 12/1997 Miura ..... B60R 19/24 403/2
5,738,319 A 4/1998 Grassi
5,827,026 A * 10/1998 Patti ..... F16B 2/065 411/112
D407,010 S 3/1999 Sobczynski
6,453,523 B1 * 9/2002 Teidemann ..... B60R 11/00 224/560
6,460,820 B1 * 10/2002 Kopp ..... F16M 7/00 248/500
D568,727 S 5/2008 Walker et al.
(Continued)

OTHER PUBLICATIONS

The Free Dictionary, Definition of Planar, Retrieved Mar. 20, 2018, https://www.thefreedictionary.com/planar. (Year: 2018).

*Primary Examiner* — Jonathan Liu
*Assistant Examiner* — Guang H Guan
(74) *Attorney, Agent, or Firm* — Norton Rose Fulbright US LLP

(57) ABSTRACT

A clamp for securing an air conditioning unit in a window without the need for any modification and/or damage to the air conditioning unit or window. The clamp includes a plurality of planar members forming two oppositely facing channels. A first channel engages the air conditioning unit rail while a second channel engages the window sash of the window. The clamp further includes two fasteners to abut the window sash and the air conditioning unit rail. The clamp therefore prevents the window from being opened and the air conditioning unit from being pushed through the window.

7 Claims, 7 Drawing Sheets

(56) References Cited

U.S. PATENT DOCUMENTS

| | | | | |
|---|---|---|---|---|
| 7,392,589 | B2 * | 7/2008 | Friegang | A47B 96/00 33/41.6 |
| 7,789,359 | B2 * | 9/2010 | Chopp, Jr. | H02G 3/0456 182/129 |
| 7,887,017 | B2 * | 2/2011 | Moran | B44C 5/00 248/215 |
| 7,938,376 | B2 | 5/2011 | Jimenez et al. | |
| 8,262,040 | B1 * | 9/2012 | Haucke | B60D 1/66 248/215 |
| 8,544,899 | B2 * | 10/2013 | Hertrich | E05B 65/0014 292/195 |
| 8,640,477 | B1 * | 2/2014 | Merideth | F24F 13/32 62/259.1 |
| D704,834 | S * | 5/2014 | Bacon | D24/128 |
| D727,716 | S | 4/2015 | Langle | |
| D735,017 | S | 7/2015 | Langle | |
| 9,157,572 | B1 * | 10/2015 | Merideth | F24F 13/32 |
| D781,689 | S | 3/2017 | Darby | |
| D781,690 | S | 3/2017 | Darby | |
| D782,290 | S | 3/2017 | Darby | |
| 2015/0322701 | A1 | 11/2015 | Smith | |
| 2017/0328596 | A1 | 11/2017 | Darby | |

* cited by examiner

APPARATUS AND METHOD FOR SECURING AN AIR CONDITIONING UNIT IN A WINDOW

BACKGROUND

Window air conditioning units are conveniently designed to allow for easy installation and removal, but this is problematic as they are often left unsecured in the window. A potential thief may easily lift the window and/or push an unsecured air conditioning unit to gain entry to a house. This is of particular concern for first floor air conditioning units, which are more accessible.

Current techniques exist to secure an air conditioning unit in a window to deter would-be thieves, but these methods often prove invasive and time consuming to install, requiring separate tools and know-how. Air conditioning units often come with hardware enabling a user to screw the unit directly into the window frame. This damages both the air conditioning unit and window frame and requires the use of separate tools. Other methods include using a bracket to screw directly into the window frame, which is unsightly and invasive, resulting in permanent damage to the window frame, air conditioning unit, or both. These methods are also time consuming to install and uninstall. A need exists for an air conditioning unit security system that provides sufficient security to prevent the window from being pushed up and/or prevents the air conditioning unit from being pushed through the window without damaging or otherwise modifying the air conditioning unit or the window in which it is secured.

SUMMARY

In one aspect of the present disclosure, a clamp secures an air conditioning unit in a window without requiring modification and/or damage to the air conditioning unit or window. The clamp for securing an air conditioning unit in a window, where the air conditioning unit includes a rail the clamp may engage, includes a first planar member, a second planar member, and a third planar member forming a first channel, where the first channel is adapted to engage the air conditioning unit rail. The clamp also includes the third planar member, a fourth planar member, and a fifth planar member forming a second channel, where the second channel is adapted to engage a window sash of the window, the second channel and the first channel facing opposite directions. The first planar member further comprises a first aperture and a second aperture, the first aperture adapted to receive a first fastener and the second aperture adapted to receive a second fastener. The third planar member further comprises a third aperture substantially aligned with the first aperture of the first planar member, where the third aperture is adapted to receive the first fastener.

In another aspect of the present disclosure, a method for securing an air conditioning unit in a window includes utilizing a first planar member, a second planar member, and a third planar member to form a first channel, the first channel utilized to engage an air conditioning unit rail of the air conditioning unit. The method also includes utilizing the third planar member, a fourth planar member, and a fifth planar member to form a second channel, the second channel utilized to engage a window sash of the window, wherein the second channel and the first channel face opposite directions. The method further includes utilizing a first and a second fastener, wherein the first fastener is utilized to penetrate the first planar member and the third planar member to abut the window sash within the second channel, and the second fastener is utilized to penetrate the first planar member to abut the air conditioning unit rail within the first channel.

In another aspect of the present disclosure, a clamp for securing an air conditioning unit in a window, where the air conditioning unit includes a rail the clamp may engage, includes a first planar member, a second planar member, and a third planar member forming a first channel, where the first channel is adapted to engage the air conditioning unit rail. The clamp also includes the third planar member, a fourth planar member, and a fifth planar member that form a second channel, and the second channel is adapted to engage a window sash of the window, where the second channel and the first channel face opposite directions. The third planar member further includes one or more inwardly projecting tabs adapted to engage the air conditioning unit rail.

In another aspect of the present disclosure, a system for securing an air conditioning unit in a window, where the air conditioning unit includes a rail the system may engage, includes a first channel adapted to engage the air conditioning unit rail, where the first channel is formed by a first planar member, a second planar member, and a third planar member, where the first planar member is adapted to receive a first and a second fastener, and the third planar member is adapted to receive the first fastener and includes one or more inwardly projecting tabs adapted to engage the air conditioning unit rail. The system also includes an opposite facing second channel adapted to engage a window sash of the window, where the second channel is formed by the third planar member, a fourth planar member, and a fifth planar member.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

Embodiments described herein provide systems that secure an air conditioning unit in a window without damaging or otherwise modifying the air conditioning unit or the window. Certain embodiments may be modular, comprising components that are of adjustable dimensions and configurations, being able to accommodate standard (albeit different) window dimensions and air conditioning units of various dimensions. This modularity also provides for easy packaging, assembly, and repair or flexible arrangement and use. Components of systems described herein are thought to advantageously comprise one or a combination of lightweight materials that impart sufficient strength such as, for example, steel, aluminum, or fiber-reinforced plastic, and the like.

Figure 1:
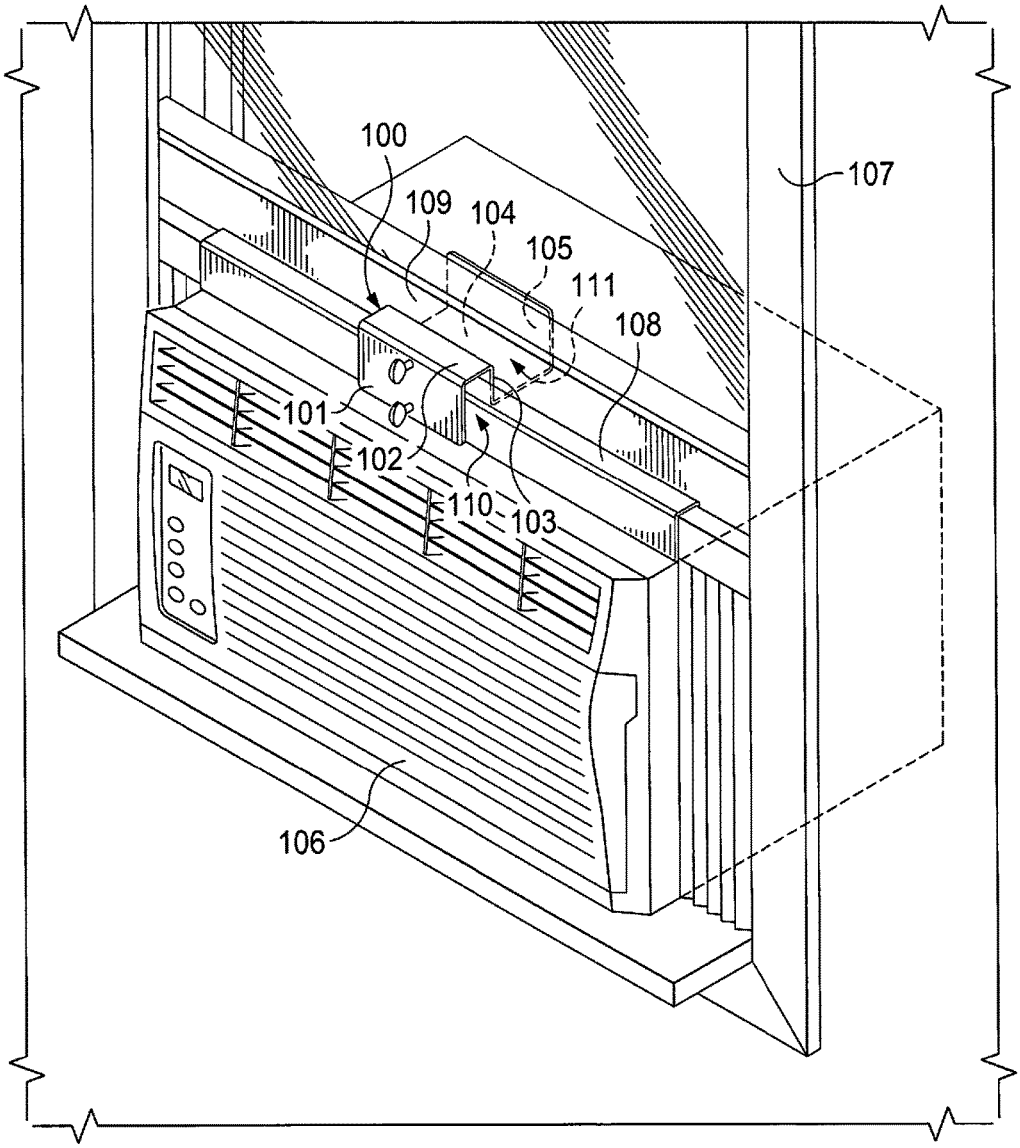
FIG. 1 illustrates an in-use perspective view of an embodiment of a clamp for securing an air conditioning unit in which concepts described herein are applied.

FIG. 1 illustrates a perspective view of an embodiment of clamp 100. Clamp 100 comprises planar member 101, planar member 102, planar member 103, planar member 104, and planar member 105 for securing air conditioning unit 106 in window 107 in which concepts described herein are applied. An embodiment of clamp 100 biases air conditioning unit rail 108 and window sash 109. Planar member 101, planar member 102, and planar member 103 form first channel 110 of clamp 100, which is adapted to receive air conditioning unit rail 108. Planar member 103, planar member 104, and planar member 105 form second channel 111, which is adapted to receive window sash 109.

Figure 2:
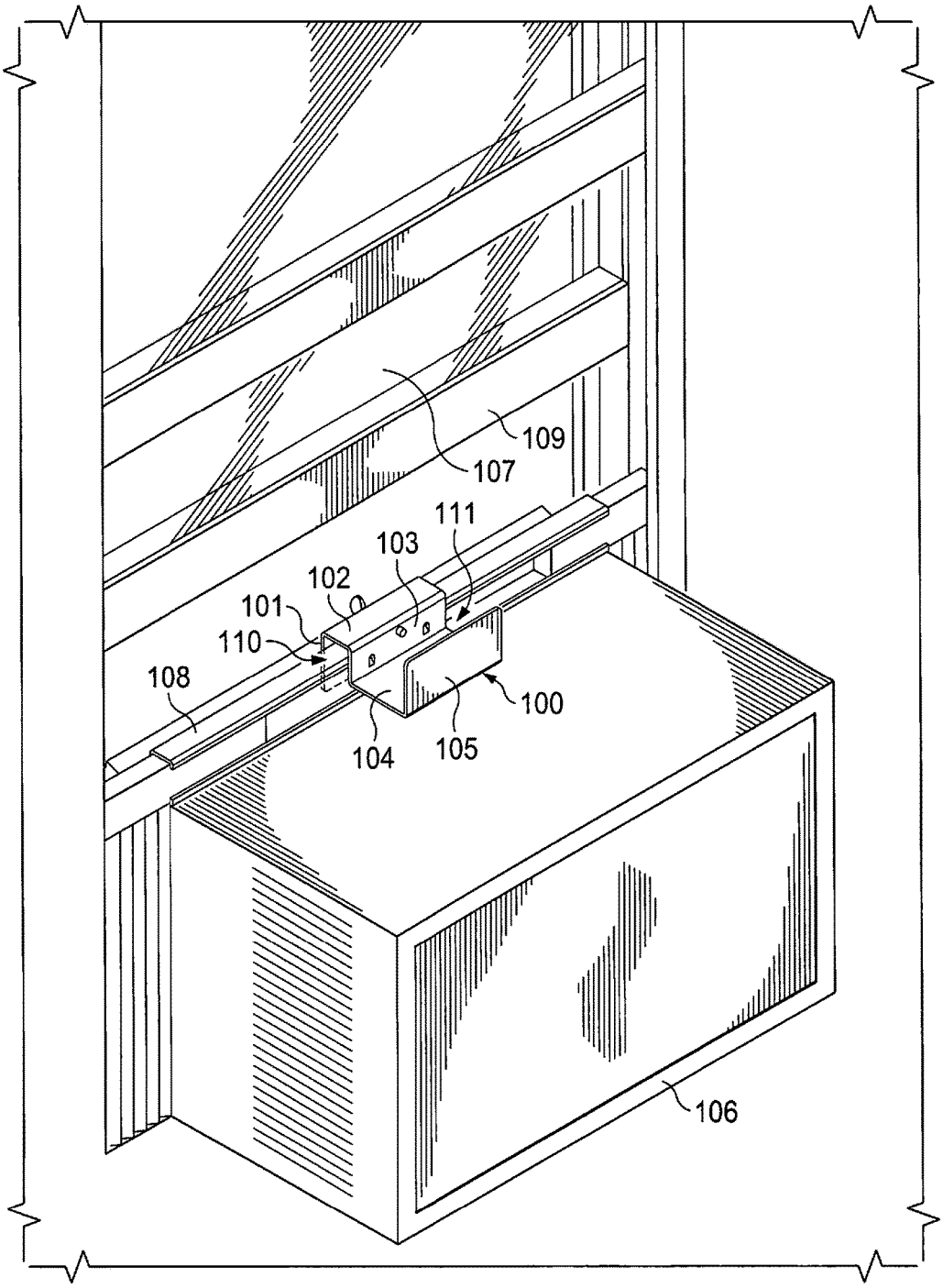
FIG. 2 illustrates an additional in-use perspective view of an embodiment of a clamp for securing an air conditioning unit in which concepts described herein are applied.

As shown in FIG. 1, and further illustrated by the perspective view in FIG. 2, first channel 110 and second channel 111 face opposite directions to form clamp 100. Each may be reversibly attached to the other by fasteners, locking/mating grooves, and the like. Each may also fold or actuate at hinges or the like. When clamp 100 secures air conditioning unit 106, as seen, planar member 101 is oriented at the interior of a building and planar member 105 is oriented at the exterior of window 107, while planar member 103 is oriented in between air conditioning unit rail 108 and window sash 109. In this way, clamp 100 can be thought as comprising inner, outer, and middle portions. Clamp 100 prevents air conditioning unit 106 from being forced through the window and/or prevents window 107 from being forced open. As will be described in more detail, clamp 100 operates to secure air conditioning unit 106 in window 107 without requiring any damage and/or modification to air conditioning unit 106 or window 107.

While the illustrated embodiment of clamp 100 is a single contiguous component, it should be appreciated that planar member 101, planar member 102, planar member 103, planar member 104, and planar member 105 may, in fact, comprise several structures that may be configured according to specific dimensions of an air conditioning unit and window sash. The length, width, and shape of each planar member of clamp 100 may be adapted to accommodate different sizes of air conditioning units and window sashes of different thicknesses. The shape and size of planar member 101 may vary. For instance, the corners of planar member 101 may be rounded, or planar member 101 may include a triangular, square, or circular shape. Additionally, a soft material, such as rubber or a rubber composite, may cover any of the surfaces of planar member 101, planar member 102, planar member 103, planar member 104, and planar member 105 to prevent damage to air conditioning unit rail 108 and/or window sash 109, as well as provide vibration isolation.

Figure 3:
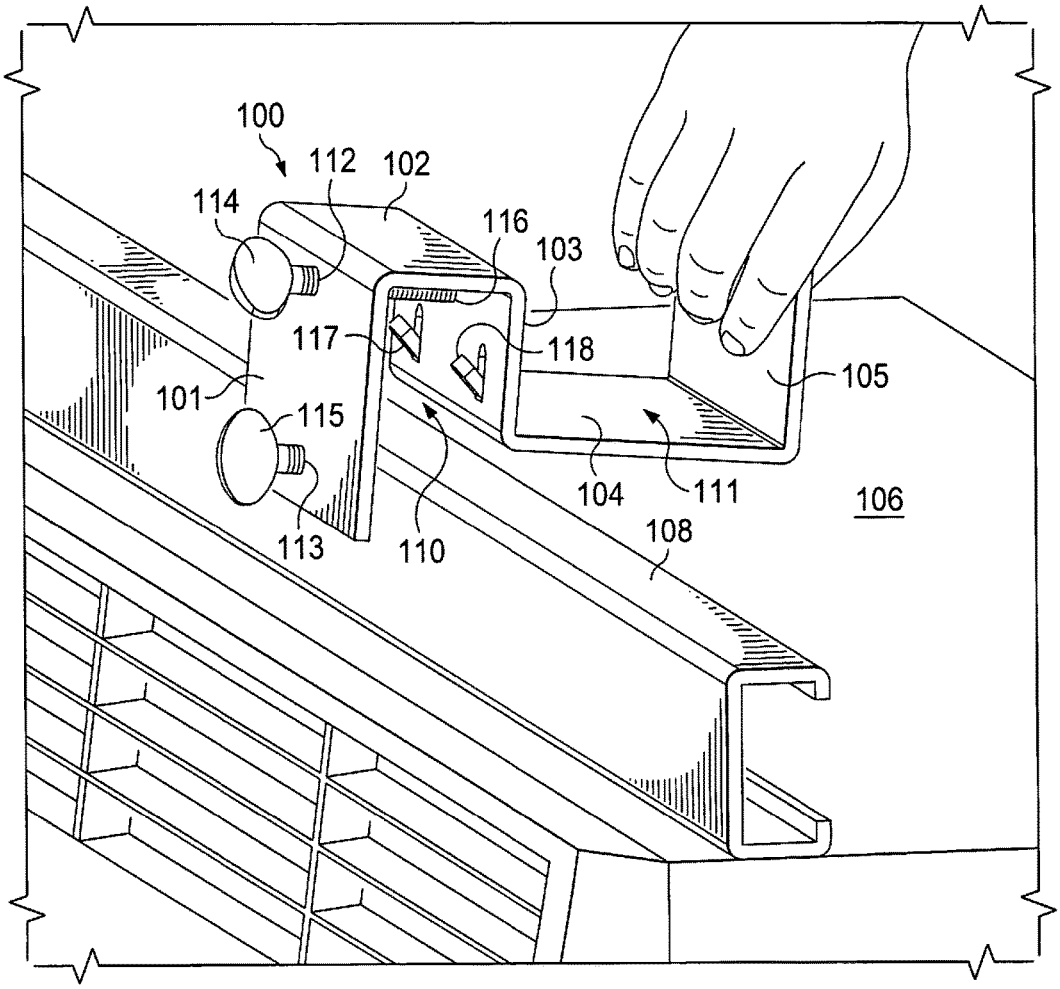
FIG. 3 illustrates a perspective view of an embodiment of a clamp for securing an air conditioning unit in which concepts described herein are applied.

As shown in FIG. 3, planar member 101 is configured to abut the front, or interior-facing, surface of air conditioning rail 108. In the illustrated embodiment, planar member 101 may be configured with two apertures (such as aperture 112 and aperture 113). Aperture 112 and aperture 113 may be located substantially in the center of planar member 101 and further configured to accept fasteners. The sizes of aperture 112 and aperture 113 may be configured to accept various types and sizes of fasteners as further discussed herein. In one embodiment, aperture 112 may be located closer to planar member 102, that is, at a greater distance from aperture 113. The placement of aperture 112 may vary depending on the height of air conditioning unit rail 108. In a preferred embodiment, aperture 112 and aperture 113 may be threaded to accept threaded fasteners.

Figure 4:
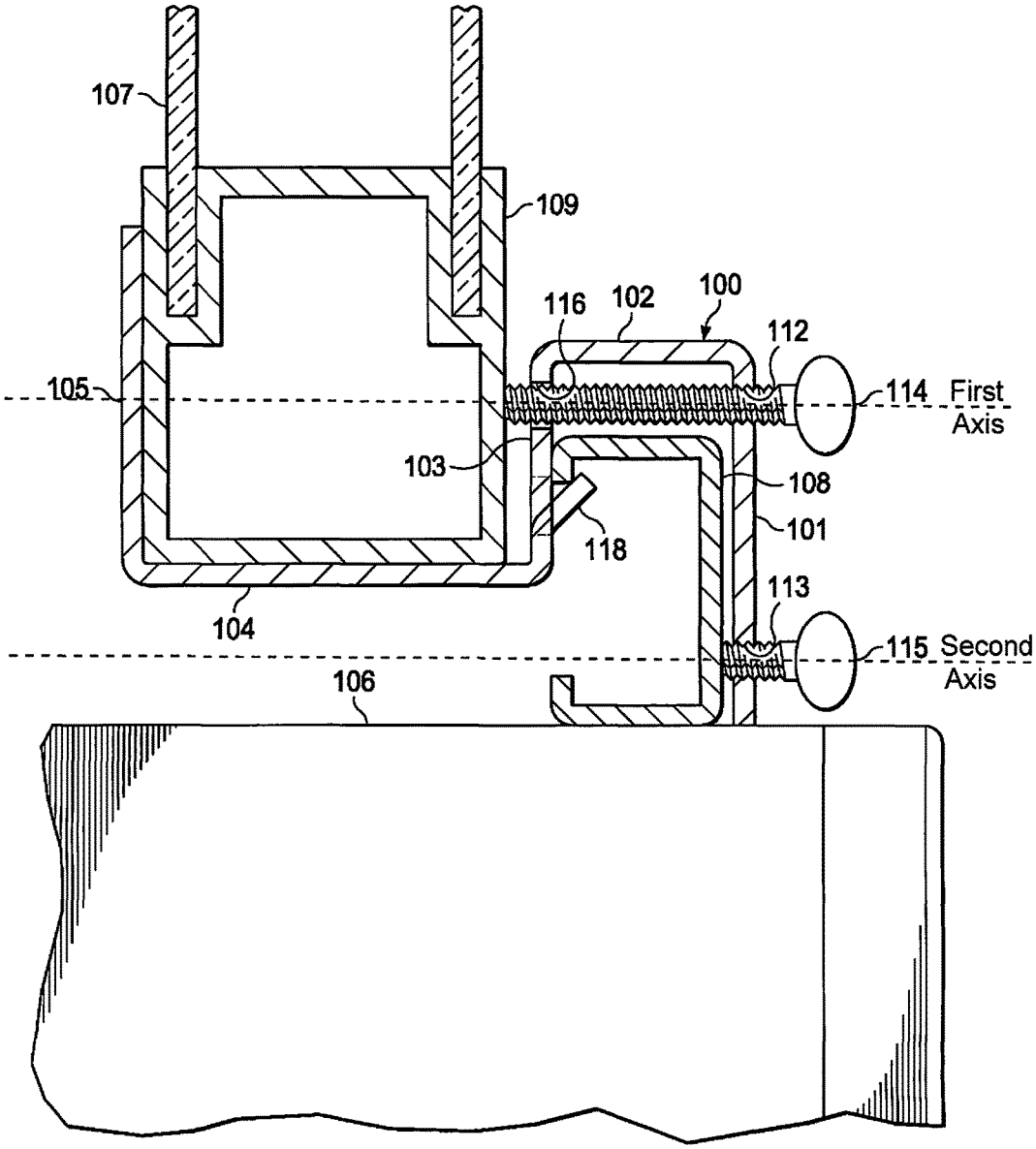
FIG. 4 illustrates a sectional view of an embodiment of a clamp for securing an air conditioning unit in which concepts described herein are applied.

As shown in FIG. 4, according to one embodiment, threaded fasteners (such as thumbscrew 114 and thumbscrew 115) may be used to bias air conditioning unit rail 108 and window sash 109 with sufficient force making it difficult for one to move window 107 with respect to air conditioning unit 106. It should be appreciated that other embodiments may comprise fasteners including, but not limited to bolts, clips, nails, pins, pegs, rivets, and threaded fasteners such as thumbscrews, metal screws, wood screws, self-tapping screws, and the like.

As shown in FIG. 4, according to one embodiment, thumbscrew 114 is threaded through aperture 112 and further threaded through aperture 116 in planar member 103. Thumbscrew 114 passes above air conditioning unit rail 108 thereby preventing any damage or modification to air conditioning unit rail 108. Tightening thumbscrew 114 causes thumbscrew 114 to abut window sash 109, which is received by second channel 111. Tightening thumbscrew 114 with sufficient force biases window sash 109 against planar member 105. The biasing of window sash 109 against planar member 105 secures window 107 to clamp 100. Similarly, thumbscrew 115 is threaded through aperture 113 to abut air conditioning unit rail 108. Thumbscrew 115 operates to sufficiently bias air conditioning unit rail 108 in first channel 110 against planar member 103 without damage or modification of air conditioning rail 108. With window sash 109 biased against planar member 105 by thumbscrew 114 and air conditioning unit rail 108 biased against planar member 103 by thumbscrew 115, the window is prevented from being opened.

As shown in FIG. 4, planar member 103 may include one or more inwardly projecting tabs (such as tab 117 and tab 118) adapted to engage air conditioning unit rail 108. The inwardly projecting tabs operate in conjunction with the biasing action of thumbscrew 114 and thumbscrew 115. Tab 117 and tab 118 operate to prevent clamp 100 from being separated from air conditioning rail 108 when clamp 100 and air conditioning rail 108 are biased with thumbscrew 114 and thumbscrew 115. Air conditioning unit rails typically comprise a C-shaped profile as shown by FIG. 4. Air conditioning rail 108 comprises a vertical interior facing portion parallel to planar member 101 and a perpendicular horizontal portion that extends therefrom, parallel to planar member 102. When thumbscrew 115 is tightened against air conditioning rail 108, this causes the C-shaped horizontal portion of air conditioning unit rail 108 to cross above tab 117 and tab 118. Tab 117 and tab 118 extend outwardly at a sufficient angle and length, thereby engaging air conditioning unit rail 108 when air conditioning unit rail 108 is sufficiently biased against planar member 103. As a result of the orientation shown in FIG. 4, clamp 100 and window 107 are secured together and window 107 is prevented from being lifted and air conditioning unit 106 is secure.

The inwardly projecting tabs may vary in length and position to adapt to various dimensions of air conditioning rails. According to one embodiment, the inwardly projecting tabs may be adjustable to adapt to different air conditioning rails. Another embodiment may include removable caps to place over the tabs in order to properly engage an air conditioning unit rail. FIG. 4 illustrates tab 117 and tab 118 projecting inwards at approximately forty-five degrees, although other embodiments may include tabs projecting at different angles.

Figure 5:
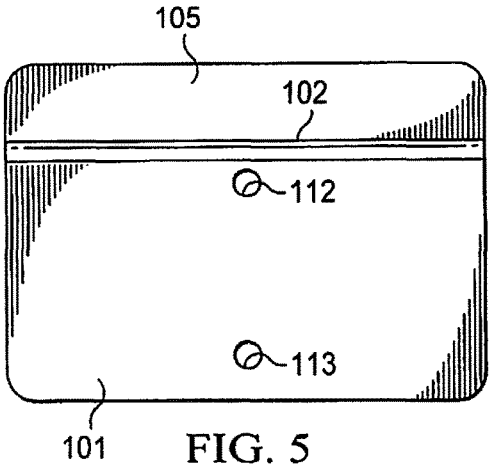
FIG. 5 illustrates a front view of an embodiment of a clamp for securing an air conditioning unit in which concepts described herein are applied.
Figure 6:
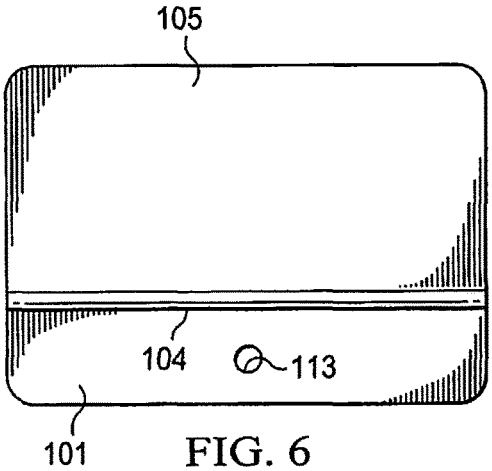
FIG. 6 illustrates a rear view of an embodiment of a clamp for securing an air conditioning unit in which concepts described herein are applied.
Figure 7:
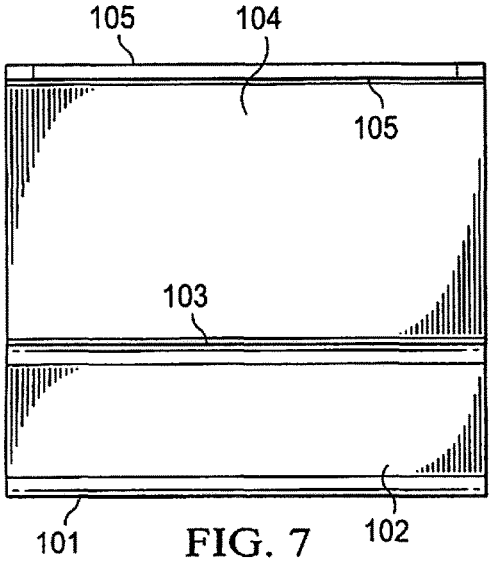
FIG. 7 illustrates a top view of an embodiment of a clamp for securing an air conditioning unit in which concepts described herein are applied.
Figure 8:
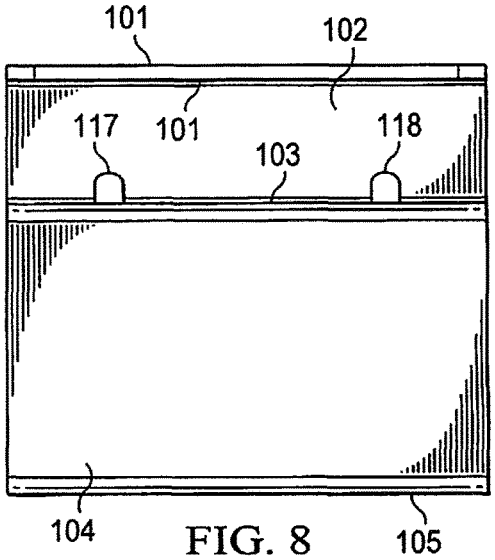
FIG. 8 illustrates a bottom view of an embodiment of a clamp for securing an air conditioning unit in which concepts described herein are applied.

FIG. 5 illustrates an additional perspective view of the embodiment, displaying the interior facing planar member 101 and portion of planar member 105 protruding above planar member 102. FIG. 6 illustrates an additional perspective view of the embodiment, displaying exterior facing planar member 105 and portion of planar member 101 protruding below planar member 104. FIG. 7 illustrates an additional perspective view of the embodiment, displaying the top of clamp 100 and second channel 111. FIG. 8 illustrates an additional perspective view of the embodiment, displaying the bottom of clamp 100, with tab 117 and tab 118 visibly protruding from planar member 103 into first channel 110.

Figure 9:
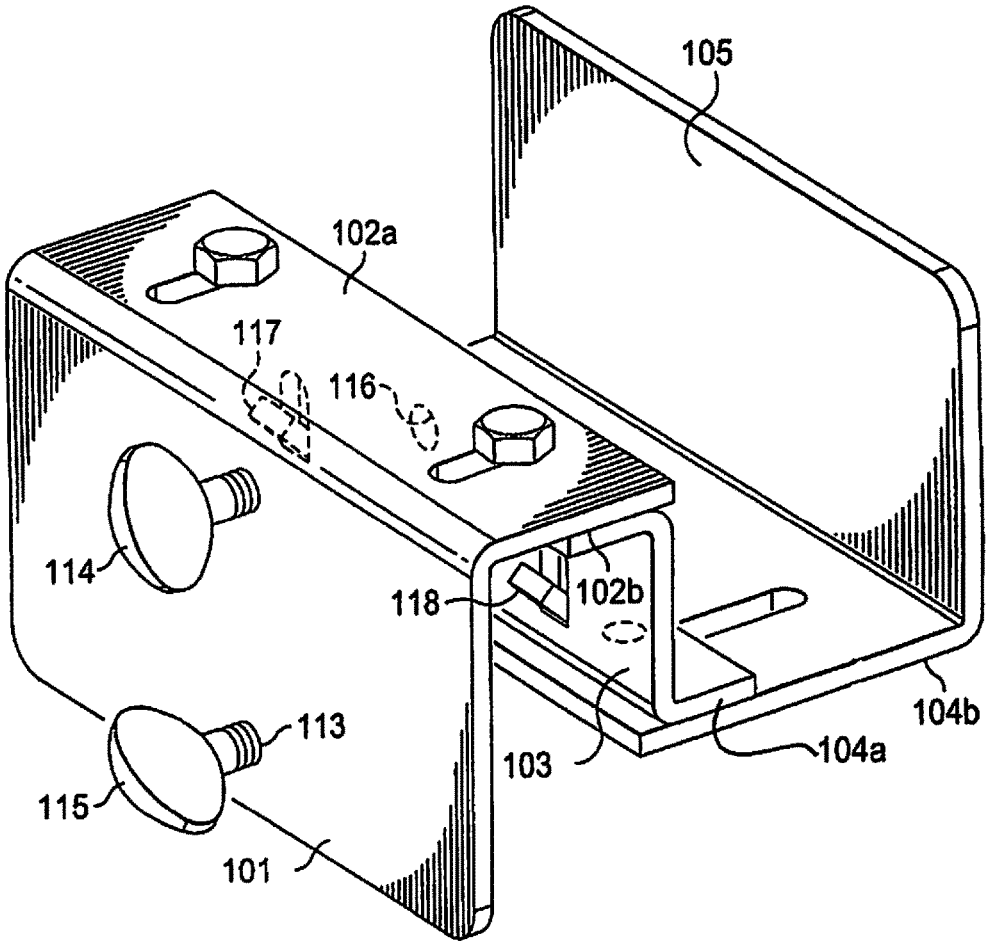
FIG. 9 illustrates an additional embodiment of a clamp for securing an air conditioning unit in which concepts described herein are applied.

As shown in FIG. 9, planar member 102 comprises segment 102*a* and segment 102*b*, which can be moved with respect to one another to adjust the effective width or depth of first channel 110 to adapt to a different sized air conditioning unit rail. Similarly, planar member 104 comprises segment 104*a* and segment 104*b*, which can be moved with respect to one another to adjust the effective width or depth of second channel 111 to adapt to different sized window sashes. According to one embodiment, the length of can be adjusted where, e.g., planar member 102 and planar member 104 each may comprise two pieces, where one slides along the length of another to form a desired length. Consistent with the discussion herein, the lengths and/or widths may be fixed by a reversible fastener means, one or more securing pins or bolts, latch mechanism, or the like.

Planar member 102 and planar member 104 may each comprise an outer sleeve and an inner sleeve, where length is adjusted by sliding the inner sleeve and the outer sleeve along their length with respect to one another. Length adjustments may be performed by aligning appropriate apertures in the inner sleeve and outer sleeve and inserting a securing pin or fastener through the aligned apertures. Length adjustments may also be performed by sliding the sleeves or segments along a series of notches or grooves so that each is seated in a desired notch or groove at the secured length.

Figure 10:
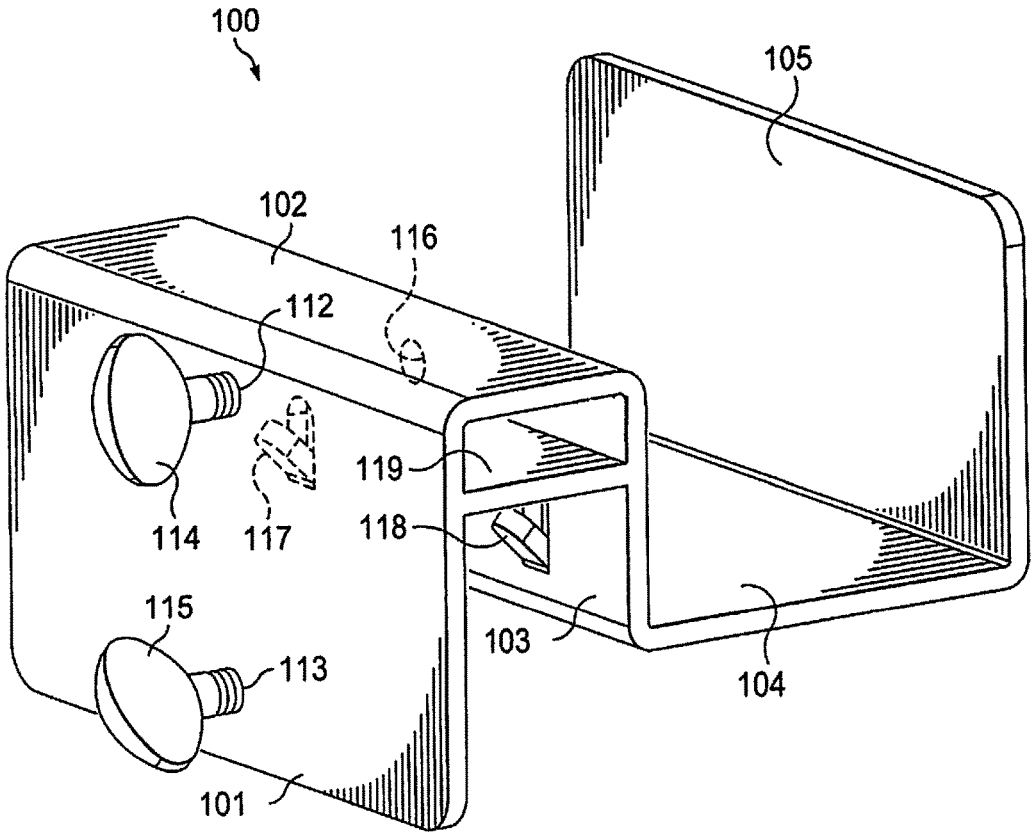
FIG. 10 illustrates an additional embodiment of a clamp for securing an air conditioning unit in which concepts described herein are applied.

As shown in FIG. 10, according to one embodiment, clamp 100 comprises an additional planar member 119. Planar member 119 extends between planar member 101 and planar member 103 and is substantially parallel to planar member 102. Planar member 119 may operate to rest on an air conditioning unit rail as it is positioned below aperture 112 of planar member 101 and aperture 116 of planar member 103. Planar member 119 may operate to further provide stability and to prevent any potential damage to air conditioning until rail 108.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

The invention claimed is:

1. A clamp for securing an air conditioning unit in a window where the air conditioning unit comprises an air conditioning unit rail engageable by the clamp, the clamp comprising:

a first planar member, a second planar member, and a third planar member forming a first channel, the first channel adapted to engage the air conditioning unit rail;

the third planar member, a fourth planar member, and a fifth planar member forming a second channel, the second channel adapted to engage a window sash of the window, wherein the second channel and the first channel face opposite directions;

a first threaded fastener;

a second threaded fastener;

wherein the first planar member comprises a first aperture with a first axis substantially orthogonal to the first planar member, and a second aperture with a second axis substantially orthogonal to the first planar member and substantially parallel to the first axis, the first aperture adapted to receive the first threaded fastener and the second aperture adapted to receive the second threaded fastener, wherein the first axis intersects the second channel, and wherein the second axis does not intersect the second channel; and wherein the third planar member comprises a third aperture substantially aligned with the first aperture of the first planar member, wherein the third aperture is adapted to receive the first threaded fastener, wherein the first threaded fastener is configured to extend through the first channel into the second channel after the first threaded fastener is inserted into the first aperture, and wherein the second threaded fastener is configured to extend into the first channel without extending into the second channel after the second threaded fastener is inserted into the second aperture.

2. The clamp of claim 1, wherein the first threaded fastener is adapted to penetrate the first planar member and the third planar member to abut the window sash within the second channel, and wherein the second threaded fastener is adapted to penetrate the first planar member to abut the air conditioning unit rail within the first channel.

3. The clamp of claim 2, wherein the first threaded fastener and the second threaded fastener are threaded thumbscrews.

4. The clamp of claim 1, wherein one or more inwardly projecting tabs extend from the third planar member and are adapted to engage the air conditioning unit rail.

5. The clamp of claim 4, wherein the one or more inwardly projecting tabs are positioned at a forty-five degree angle, with respect to the third planar member, into the first channel.

6. The clamp of claim 1, wherein the first channel and the second channel are formed from a contiguous piece of material.

7. A system for securing an air conditioning unit in a window, the air conditioning unit comprising an air conditioning unit rail engageable by the system, the system comprising:

a first threaded fastener having a first length;

a second threaded fastener having a second length;

a first channel adapted to engage the air conditioning unit rail, wherein the first channel is formed by a first planar member, a second planar member, and a third planar member, wherein the first planar member includes a first aperture and a second aperture, wherein the first planar member is adapted to receive the first threaded fastener into the first aperture of the first planar member, and the second threaded fastener into the second aperture of the first planar member, wherein the first aperture includes a first axis substantially orthogonal to the first planar member, wherein the second aperture includes a second axis substantially orthogonal to the first planar member and substantially parallel to the first axis, wherein the third planar member is adapted to receive the first threaded fastener, and wherein one or more inwardly projecting tabs extend from the third planar member and are adapted to engage the air conditioning unit rail; and a second channel adapted to engage a window sash of the window, wherein the second channel is formed by the third planar member, a fourth planar member, and a fifth planar member, wherein the first channel and the second channel face opposite directions, wherein the first axis intersects the second channel, and wherein the second axis does not intersect the second channel;

wherein the first threaded fastener is configured to extend through the first channel into the second channel after the first threaded fastener is inserted into the first aperture, and wherein the second threaded fastener is configured to extend into the first channel without extending into the second channel after the second threaded fastener is inserted into the second aperture.

* * * * *